US011204572B2

(12) United States Patent
Oka et al.

(10) Patent No.: US 11,204,572 B2
(45) Date of Patent: Dec. 21, 2021

(54) IMAGE FORMING APPARATUS

(71) Applicant: FUJIFILM BUSINESS INNOVATION CORP., Tokyo (JP)

(72) Inventors: Hirooki Oka, Kanagawa (JP); Tetsuo Hara, Kanagawa (JP); Joji Saito, Kanagawa (JP); Haruhiko Kojima, Kanagawa (JP); Hiroshi Kimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 218 days.

(21) Appl. No.: 16/212,727

(22) Filed: Dec. 7, 2018

(65) Prior Publication Data

US 2019/0286043 A1 Sep. 19, 2019

(30) Foreign Application Priority Data

Mar. 14, 2018 (JP) ..... JP2018-046340
Mar. 14, 2018 (JP) ..... JP2018-046341

(51) Int. Cl.
*G03G 15/23* (2006.01)
*G03G 15/16* (2006.01)
*G03G 15/00* (2006.01)

(52) U.S. Cl.
CPC ..... *G03G 15/234* (2013.01); *G03G 15/1605* (2013.01); *G03G 15/5029* (2013.01);
(Continued)

(58) Field of Classification Search
CPC ..... G03G 15/23–234; G03G 15/5029; G03G 15/65; G03G 15/6529; G03G 15/6558;
(Continued)

(56) References Cited

U.S. PATENT DOCUMENTS 6,029,020 A * 2/2000 Blackman ..... G03G 15/5029 399/45
2003/0053816 A1* 3/2003 Asai ..... H04N 1/233 399/82

(Continued)

FOREIGN PATENT DOCUMENTS

JP H05-297660 A 11/1993
JP H08-241017 A 9/1996

(Continued)

*Primary Examiner* — Carla J Therrien
(74) *Attorney, Agent, or Firm* — Oliff PLC

(57) ABSTRACT

An image forming apparatus includes: an inverting unit that inverts a sheet when an image forming process for forming images on both sides of the sheet is performed; an image forming unit that forms an image on a second side of the sheet based on first side image data and forms an image on a third side of the sheet based on second side image data; a controller that starts the image forming process upon receiving print data to be printed on specific paper, and inverts a sheet fed from a sheet feeding unit once or more; and a converting unit that, when the sheet fed from the sheet feeding unit is the specific paper, converts the first side print data which is received to be printed on the specific paper into N-th side image data where N≥2 and transfers the N-th side image data to the image forming unit.

15 Claims, 10 Drawing Sheets

(52) U.S. Cl.
CPC ..... *G03G 15/6529* (2013.01); *G03G 15/6591* (2013.01); *G03G 15/6564* (2013.01); *G03G 2215/00586* (2013.01); *G03G 2215/00932* (2013.01)

(58) Field of Classification Search
CPC ..... G03G 15/6588; G03G 15/6591; G03G 2215/00586; G03G 15/00932
See application file for complete search history.

(56) References Cited

U.S. PATENT DOCUMENTS

| | | | | |
|---|---|---|---|---|
| 2004/0130088 | A1* | 7/2004 | Sato | B65H 3/44 271/3.14 |
| 2008/0292329 | A1* | 11/2008 | Kimoto | G03G 15/5087 399/17 |
| 2010/0117349 | A1* | 5/2010 | Ivutin | B32B 27/283 283/81 |
| 2019/0286044 | A1* | 9/2019 | Saito | G03G 15/5083 |

FOREIGN PATENT DOCUMENTS

| | | | |
|---|---|---|---|
| JP | 2007-219264 | A | 8/2007 |
| JP | 2017-090678 | A | 5/2017 |

* cited by examiner

| RECEIVED MODE | MODE TO BE EXECUTED | SHEET | |
|---|---|---|---|
| | | N-TH SIDE | PRINTING IMAGE |
| SINGLE-SIDED PRINTING MODE | SPECIAL SINGLE-SIDED PRINTING MODE | FIRST SIDE | — |
| | | SECOND SIDE | FRONT SIDE IMAGE |
| DUPLEX PRINTING MODE | SPECIAL DUPLEX PRINTING MODE | FIRST SIDE | — |
| | | SECOND SIDE | FRONT SIDE IMAGE |
| | | THIRD SIDE | BACK SIDE IMAGE |

FIG.7

| PRINTING JOB | PRINTING JOB DETERMINA-TION RESULT | PRINTING DATA | IMAGE DATA | PAPER | RETRACT MECHANISM | PRINTING IMAGE |
|---|---|---|---|---|---|---|
| COPY JOB/PRINT JOB (SPECIFIC STORAGE LOCATION) | CONFIDENTIAL JOB | DATA FOR COLOR IMAGE/ DATA FOR BLACK AND WHITE IMAGE | C M Y | SECURITY PAPER | CONTACT | COLOR IMAGE OR BLACK AND WHITE IMAGE |
| | | | | PLAIN PAPER | NON-CONTACT | NO IMAGE (BLANK SHEET) |
| PRINT JOB (ANOTHER STORAGE LOCATION) | NORMAL PRINTING JOB | DATA FOR COLOR IMAGE | C M Y K | SECURITY PAPER/PLAIN PAPER | CONTACT | COLOR IMAGE |
| | | DATA FOR BLACK AND WHITE IMAGE | K | SECURITY PAPER/PLAIN PAPER | CONTACT | BLACK AND WHITE IMAGE |

IMAGE FORMING APPARATUS

CROSS-REFERENCE TO RELATED APPLICATIONS

This application is based on and claims priority under 35 USC 119 from Japanese Patent Application No. 2018-046341 filed Mar. 14, 2018 and Japanese Patent Application No. 2018-046340 filed Mar. 14, 2018.

BACKGROUND

(i) Technical Field

The present invention relates to an image forming apparatus.

(ii) Related Art

In recent years, there has been proposed an image forming apparatus capable of preventing confidential information from being printed and leaked to the outside of the company (see, e.g., JP-A-2017-90678).

The image forming apparatus described in JP-A-2017-90678 includes an image reading unit that reads a document, image carriers of each color that carry the respective toner images of cyan (C), magenta (M), yellow (Y) and black (K) colors formed on the basis of image data of each color, an intermediate transfer belt that holds a toner image primarily transferred from each of the image carriers, a sheet feeding unit that accommodates sheets of security paper in which a magnetic body is embedded or sheets of plain paper, a secondary transfer unit that secondarily transfers the toner image on the intermediate transfer belt onto a sheet transported from the sheet feeding unit side, a detecting device that detects whether the sheet fed from the sheet feeding unit is a sheet of security paper, and a signal determination circuit unit that outputs a permission for an image forming process when it is possible to detect by the detecting device that the sheet is the security paper, but issues an instruction to stop the image forming process when it is not possible to detect by the detecting device that the sheet is the security paper.

SUMMARY

Depending on a timing at which a sheet is fed from the sheet feeding unit, the image forming process may not be stopped in time and confidential information may be printed on a sheet of plain paper and then discharged. In addition, when the sheet fed from the sheet feeding unit is not security paper, stopping the sheet transportation may cause paper jam.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to an aspect of the present disclosure, there is provided an image forming apparatus including: an inverting unit that inverts a sheet by causing the sheet to pass through an inverting path when an image forming process for forming images on both sides of the sheet is performed; an image forming unit that forms an image on a second or later side of the sheet based on image data for the first side and forms an image on a third or later side of the sheet based on image data for the second side; a controller that starts the image forming process upon receiving print data as a target to be printed on specific paper, and inverts a sheet fed from a sheet feeding unit once or more by the inverting unit; and a converting unit that, when the sheet fed from the sheet feeding unit is the specific paper, converts the print data for the first side which is received as the target to be printed on the specific paper into image data for an N-th side where N≥2 and transfers the image data for the N-th side to the image forming unit.

BRIEF DESCRIPTION OF THE DRAWINGS

Exemplary embodiment(s) of the present invention will be described in detail based on the following figures, wherein:

FIG. 7 is a table for explaining an example of the operation of the image forming apparatus according to the third exemplary embodiment;

DETAILED DESCRIPTION

Figure 1:
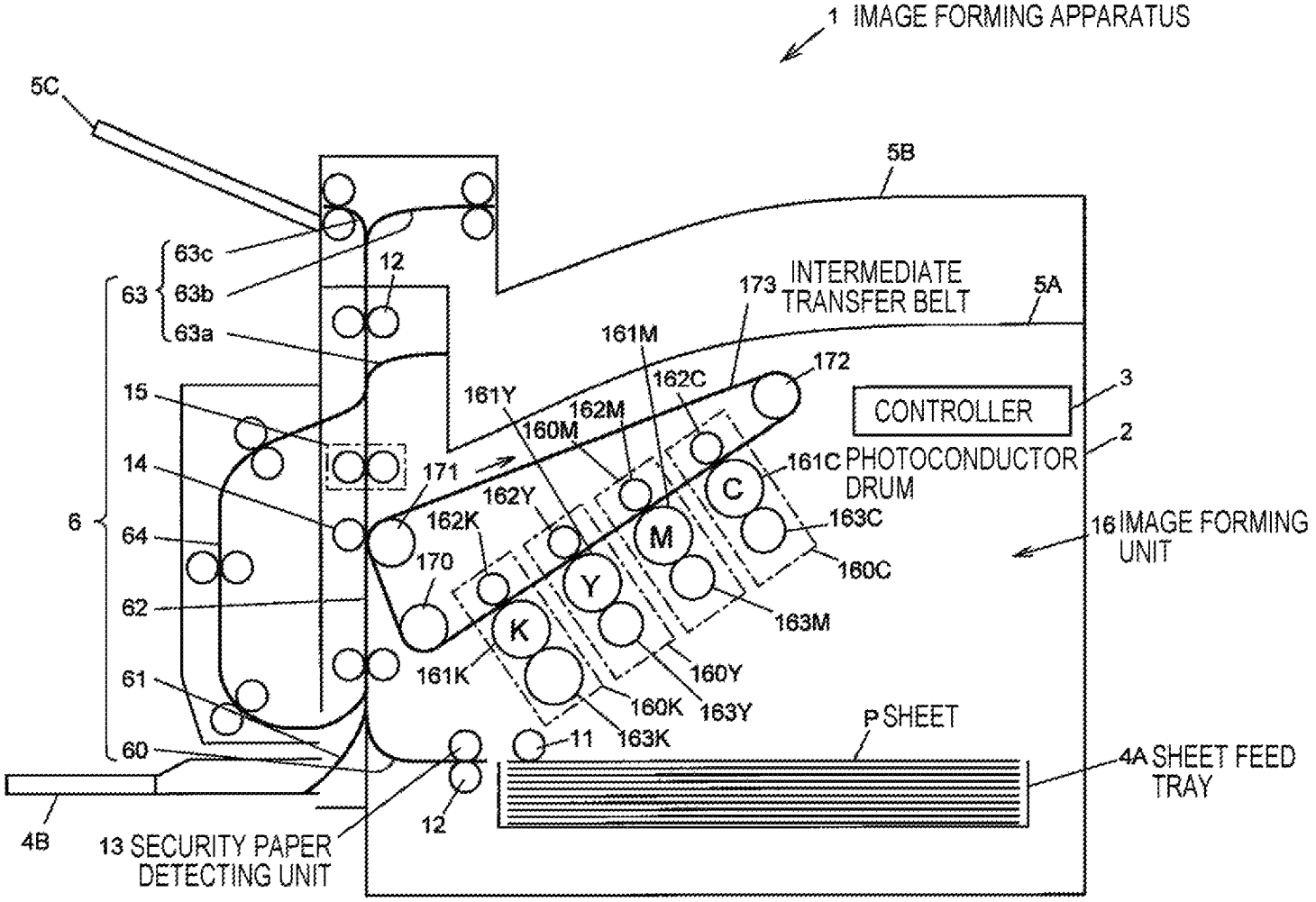
FIG. 1 is a view illustrating a schematic configuration example of an image forming apparatus according to a first exemplary embodiment of the present invention.

Hereinafter, exemplary embodiments of the present invention will be described with reference to the accompanying drawings. Throughout the drawings, the constituent elements having substantially the same function are denoted by the same reference numerals, and explanation thereof will not be repeated.

SUMMARY OF EXEMPLARY EMBODIMENT

According to an exemplary embodiment, there is provided an image forming apparatus including: an inverting unit that inverts a sheet by causing the sheet to pass through an inverting path when an image forming process for forming images on both sides of the sheet is performed; an image forming unit that forms an image on a second or later side of the sheet based on image data for the first side and forms an image on a third or later side of the sheet based on image data for the second side; a controller that starts the image forming process upon receiving print data as a target to be printed on specific paper, and inverts a sheet fed from a sheet feeding unit once or more by the inverting unit; and a converting unit that, when the sheet fed from the sheet feeding unit is the specific paper, converts the print data for the first side which is received as the target to be printed on the specific paper into image data for an N-th side where N≥2 and transfers the image data for the N-th side to the image forming unit.

"Print data" includes, for example, data obtained by using a scan function of an image forming apparatus, and data transmitted from an external device. "Image data" is data in a bitmap format obtained by converting the print data into data for a printing process.

"Specific paper" is paper provided with a magnetic body, as a representative example, without being limited thereto. "Print data as a target for printing on specific paper" is confidential information as a representative example, without being limited thereto. The confidential information includes confidential documents, drawings, photographs, images, and the like. A confidential document may include photographs, images, and the like.

In the image forming apparatus configured as described above, a sheet fed from a sheet feeding unit is caused to pass through an inverting path so as to be inverted once or more, and no image is formed on the first side of the sheet. In the meantime, it is determined whether the sheet is specific paper. When it is determined that the sheet is the specific paper, the print data for the first side is converted into image data for the third or later side and is transferred to an image forming unit. The image data on the third or later side is printed on the corresponding side of the sheet.

[Summary of Another Exemplary Embodiment]

According to another exemplary embodiment, there is provided an image forming apparatus including: a plurality of image carriers that respectively hold toner images corresponding to a plurality of color components; an intermediate transfer body that holds the toner images primarily which are transferred from the plurality of image carriers and sequentially superimposed; a secondary transfer unit that secondarily transfers the toner images on the intermediate transfer body onto a sheet; a converting unit that, upon receiving print data as a target to be printed on predetermined paper, converts the print data into image data for each of predetermined color components excluding black, the plurality of color components including the predetermined color components; and a moving unit that, when a sheet fed from a sheet feeding unit is paper other than the predetermined paper, moves the image carriers corresponding to the predetermined color components to positions at which the image carriers are in no contact with the intermediate transfer body, by relative movement to the intermediate transfer body.

"Print data" includes, for example, data obtained by using a scan function of an image forming apparatus, and data transmitted from an external device. "Image data" is data in a bitmap format obtained by converting the print data into data for a printing process, for example, CMYK image data in which a color of each pixel is expressed by CMYK values. "Predetermined color components" are, for example, color components which become black when toner images are superimposed, but may be color components which become a color other than black. "Plural image carriers" may be image carriers for cyan (C), magenta (M), yellow (Y) and black (K) colors, for example, and may include an image carrier for another color.

"Predetermined paper" is specific paper such as paper provided with a magnetic body, as a representative example, without being limited thereto. A representative example of print data as a target to be printed on predetermined paper" is confidential information. It should be noted that "print data as a target to be printed on predetermined paper" is not limited to this example. The confidential information includes confidential documents, drawings, photographs, images, and the like. A confidential document may include photographs, images, and the like.

"Relative movement" is meant to include both a case where an image carrier is moved relative to an intermediate transfer body and a case where the intermediate transfer body is moved relative to the image carrier.

In the image forming apparatus configured as described above, when a sheet fed from a sheet feeding unit is paper other than the predetermined paper, the image carriers corresponding to the predetermined color components are at positions where the image carriers are in no contact with the intermediate transfer body and the toner images of the predetermined color components are not transferred onto the intermediate transfer body. Thus, a blank sheet is discharged. When the sheet fed from the sheet feeding unit is the predetermined paper, the image carriers corresponding to the predetermined color components come into contact with the intermediate transfer body, the toner images of the predetermined color components are transferred onto the intermediate transfer body, and a sheet printed with a color obtained by superimposition of toner images of predetermined color components (e.g., black) is discharged.

First Exemplary Embodiment

FIG. 1 is a view illustrating a schematic configuration example of an image forming apparatus according to a first exemplary embodiment of the present invention;

The image forming apparatus 1 is, for example, a multifunction device having plural functions such as copying, printing, and scanning.

The image forming apparatus 1 includes a substantially box-shaped housing 2, a controller 3 disposed in the housing 2, a sheet feed tray 4A that is detachably provided in the lower portion of the housing 2 and accommodates sheets of security paper or sheets of plain paper as sheets P, a manual feed tray 4B that is detachably provided on the side surface of the housing 2, and first to third sheet discharge trays 5A to 5C which are disposed in the upper portion of the housing 2 and to which printed sheets P are discharged (hereinafter, also collectively referred to as a "sheet discharge tray 5"). The security paper is an example of specific paper. The sheet feed tray 4A and the manual feed tray 4B are examples of a sheet feeding unit.

Further, in the image forming apparatus 1, a sheet transport path 6 is formed so as to extend from the sheet feed tray 4A to the sheet discharge tray 5. The sheet transport path 6 includes a takeaway path 60, a manual feed path 61, a registration path 62, a sheet discharge path 63, and a duplex printing path 64. The duplex printing path 64 is an example of the inverting path.

The takeaway path 60 and the manual feed path 61 are paths that guide a sheet P taken from the sheet feed tray 4A to the registration path 62. The registration path 62 is a path that forms an image on the sheet P. The sheet discharge path 63 is a path that guides the sheet P on which an image has been formed to the sheet discharge tray 5. The duplex printing path 64 is a path that guides the sheet P returned at the sheet discharge path 63 to the registration path 62 again. The sheet discharge path 63 includes a first sheet discharge path 63*a* that discharges a sheet to the first sheet discharge tray 5A, a second sheet discharge path 63*b* that discharges a sheet to the second sheet discharge tray 5B, and a third sheet discharge path 63*c* that discharges a sheet to the third sheet discharge tray 5C.

On the sheet transport path 6 are arranged a pick-up roller 11 that picks the sheets P one by one from the sheet feed tray 4A into the takeaway path 60, a transport roller 12 that transports the sheet P picked up by the pick-up roller 11, a security paper detecting unit 13 that detects that the sheet P picked up by the pick-up roller 11 is security paper, an intermediate transfer belt 173 onto which a toner image is primarily transferred, a secondary transfer roller 14 that secondarily transfers the toner image on the intermediate transfer belt 173 onto the sheet P, and a fixing device 15 that fixes the toner image on the sheet P. The intermediate transfer belt 173 is an example of an intermediate transfer body. The secondary transfer roller 14 is an example of a secondary transfer unit.

The image forming apparatus 1 includes a sheet transport mechanism 17 that transports a sheet P along the sheet transport path 6. The sheet transport mechanism 17 includes a motor that rotates the pick-up roller 11, the transport roller 12, and the secondary transfer roller 14, and a drive circuit that drives the motor. The sheet transport mechanism 17 includes an inverting unit 17*a* that inverts the sheet P by causing the sheet P to pass through the duplex printing path 64.

The inverting unit 17*a* switches a guide so that the sheet P advances to the duplex printing path 64 without advancing to the sheet discharge path 63 when the sheet P exits the registration path 62. The guide guides the sheet P to advance to the sheet discharge path 63 by the spring force of a spring member and guides the sheet P to advance to the duplex printing path 64 by the operation of a solenoid.

In the image forming apparatus 1, an image forming unit 16 which forms an image is disposed above the sheet feed tray 4A in the housing 2.

The image forming unit 16 includes an intermediate transfer belt 173 stretched with tension over a driving roller 170, a backup roller 171 and a driven roller 172. The intermediate transfer belt 173 circularly moves in the direction of an arrow in the figure while coming into contact with photoconductor drums which will be described later.

In the image forming unit 16, image forming units 160C, 160M, 160Y and 160K are arranged on the intermediate transfer belt 173 to form toner images of respective colors of cyan (C), magenta (M), yellow (Y) and black (K) (hereinafter, also collectively referred to as a "image forming unit 160").

The image forming units 160 respectively includes photoconductor drums 161C, 161M, 161Y and 161K (hereinafter, also collectively referred to as a "photoconductor drum 161") on which toner images of respective colors of CMYK are formed, charging units that charge the surfaces of the photoconductor drums 161 uniformly, exposure units that irradiate the charged photoconductor drums 161 with exposure light modulated based on image data of the respective colors of CMYK to form electrostatic latent images of the respective colors of CMYK, and developing units 163C, 163M, 163Y and 163K that develop the electrostatic latent images with toner to form toner images on the surfaces of the photoconductor drums 161 (hereinafter, also collectively referred to as a "developing unit 163"). Here, the photoconductor drum 161 is an example of an image carrier. The photoconductor drum 161 may be a photoconductor belt.

Further, the image forming unit 160 includes primary transfer rollers 162C, 162M, 162Y and 162K provided on the side opposite to the photoconductor drums 161C, 161M, 161Y and, 161K, with the intermediate transfer belt 173 interposed therebetween (hereinafter, also collectively referred to as a "primary transfer roller 162). The primary transfer roller 162 transfers the toner image on the surface of the photoconductor drum 161 onto the intermediate transfer belt 173 by a pressure contact force and an electrostatic force in a nip region formed with the photoconductor drum 161.

Among the components of the image forming units 160C, 160M, 160Y and 160K, the photoconductor drum 161 and components around the photoconductor drum 161 excluding the primary transfer rollers 162C, 162M, 162Y, and 162K are hereinafter referred to as photoconductor drum units 164C, 164M, 164Y and 164K.

(Configuration for Detecting Security Paper)

A magnetic body is embedded in the security paper. As the magnetic body, a magnetic material capable of generating a large Barkhausen effect, for example, an amorphous magnetic material having a diameter of 15 to 35 μm and a length of 15 to 25 mm, may be used. The large Barkhausen effect is a phenomenon that periodic magnetization reversal occurs when an oscillating magnetic field acts.

The security paper detecting unit 13 includes an excitation coil, an antenna and a detection circuit. Upon receiving AC power, the excitation coil generates an oscillating magnetic field. When a sheet of the security paper with the magnetic body embedded therein passes through the security paper detecting unit 13, the amplitude of the oscillating magnetic field acting on the magnetic body increases. When the amplitude of the oscillating magnetic field reaches a threshold value, periodic magnetization reversal occurs in the magnetic body. The magnetic body generates an electrical pulse accompanied by the magnetization reversal. The detection circuit compares the waveform of a pulse received by the antenna with the waveform of a pulse stored in advance, and detects security paper according to the degree of match between both. Upon detecting the security paper, the security paper detecting unit 13 transmits a detection signal to a paper determining unit 304.

(Printing Mode)

The image forming apparatus 1 has, for example, a "single-sided printing mode" to form an image on one side of a sheet P, a "duplex printing mode" to form an image on both sides of the sheet P, a "special single-sided printing mode" to invert the sheet P once and form an image on the second side of the sheet, and a "special duplex printing mode" to invert the sheet P twice and form an image on both sides of the sheet P. The single-sided printing mode is an example of a single-sided image forming process. The duplex printing mode is an example of a duplex image forming process. The special single-sided printing mode is an example of a specific single-sided image forming process. The special duplex printing mode is an example of a specific duplex image forming process.

Further, in the "single-sided printing mode", the "duplex printing mode", the "special single-sided printing mode" and the "special duplex printing mode", the image forming apparatus 1 may designate "back side discharge" for discharging a sheet with a first printed side being the back side of the sheet or "front side discharge" for discharging a sheet with a first printed side being the front side of the sheet.

In the case of "back side discharge" of the single-sided printing mode, the sheet P is transported through the takeaway path 60 or the manual feed path 61, and the front side thereof is printed by the registration path 62 and discharged to the first sheet discharge tray 5A or the second sheet discharge tray 5B.

In the case of "front side discharge" in the single-sided printing mode, the front side of the sheet P is printed and discharged to the third sheet discharge tray 5C through the same path as in the case of "back side discharge" of the single-sided printing mode.

In the case of "back side discharge" of the duplex printing mode, the sheet P is transported through the takeaway path 60 or the manual feed path 61 and the front side thereof is printed by the registration path 62. Thereafter, the sheet P is returned by the second sheet discharge path 63*b* and is inverted by passing through the duplex printing path 64. The back side thereof is then printed by the registration path 62 and is discharged to the third sheet discharge tray 5C.

In the case of "front side discharge" of the duplex printing mode, when the sheet P is security paper, the front side of the sheet P is printed and then the back side of the sheet P is printed through the same paths as in the case of "back side discharge" of the duplex printing mode and the sheet P is discharged to the first sheet discharge tray 5A or the second sheet discharge tray 5B.

In the case of "back side discharge" of the special single-sided printing mode, when the sheet P is security paper, the sheet P is transported through the takeaway path 60 or the manual feed path 61, and the front side thereof (first side) is not printed by the registration path 62. Thereafter, the sheet P is returned by the second sheet discharge path 63*b*, is inverted by passing through the duplex printing path 64. The back side thereof (second side) is then printed by the registration path 62 and discharged to the first sheet discharge tray 5A or the second sheet discharge tray 5B. When the sheet P is plain paper, the sheet P is discharged as a blank sheet to the first sheet discharge tray 5A or the second sheet discharge tray 5B with nothing being printed on the front side and the back side of the sheet P.

In the case of "front side discharge" of the special single-sided printing mode, when the sheet P is security paper, the back side of the sheet P is printed, without the front side thereof not being printed, is discharged to the third sheet discharge tray 5C through the same path as in the case of "back side discharge" of the special single-sided printing mode. When the sheet P is a sheet of plain paper, the sheet P is discharged as a blank sheet to the third sheet discharge tray 5C with nothing being printed on the front side and the back side of the sheet P.

In the case of "back side discharge" of the special duplex printing mode, when the sheet P is security paper, the sheet P is transported through the takeaway path 60 or the manual feed path 61, and the front side thereof (first side) is not printed by the registration path 62. Thereafter, the sheet P is returned by the second sheet discharge path 63*b* and is inverted by passing through the duplex printing path 64, and the back side thereof (second side) is printed by the registration path 62. Here, the sheet P is returned again by the second sheet discharge path 63*b*, is inverted by passing through the duplex printing path 64. Then, the front side thereof (third side) is printed and discharged to the third sheet discharge tray 5C. When the sheet P is a sheet of plain paper, the sheet P is discharged as a blank sheet to the third sheet discharge tray 5C with nothing being printed on the front side and the back side of the sheet P.

In the case of "front side discharge" of the special duplex printing mode, when the sheet P is security paper, the back side of the sheet P is printed, and the front side thereof is printed, and is then discharged to the first sheet discharge tray 5A or the second sheet discharge tray 5B through the same path as in the case of "back side discharge" of the special duplex printing mode. When the sheet P is plain paper, the sheet P is discharged as a blank sheet to the first sheet discharge tray 5A or the second sheet discharge tray 5B with nothing being printed on the front side and the back side of the sheet P.

In the image forming apparatus 1 configured as described above, when toner images of respective colors of CMYK are superimposed and primarily transferred onto the intermediate transfer belt 173 based on image data of respective colors of CMYK, the toner images are secondarily transferred onto the sheet P fed from the sheet feed tray 4A. Then, after the toner images transferred onto the sheet P are fixed on the sheet P by the fixing device 15, the sheet P is discharged to the sheet discharge tray 5.

Figure 2:
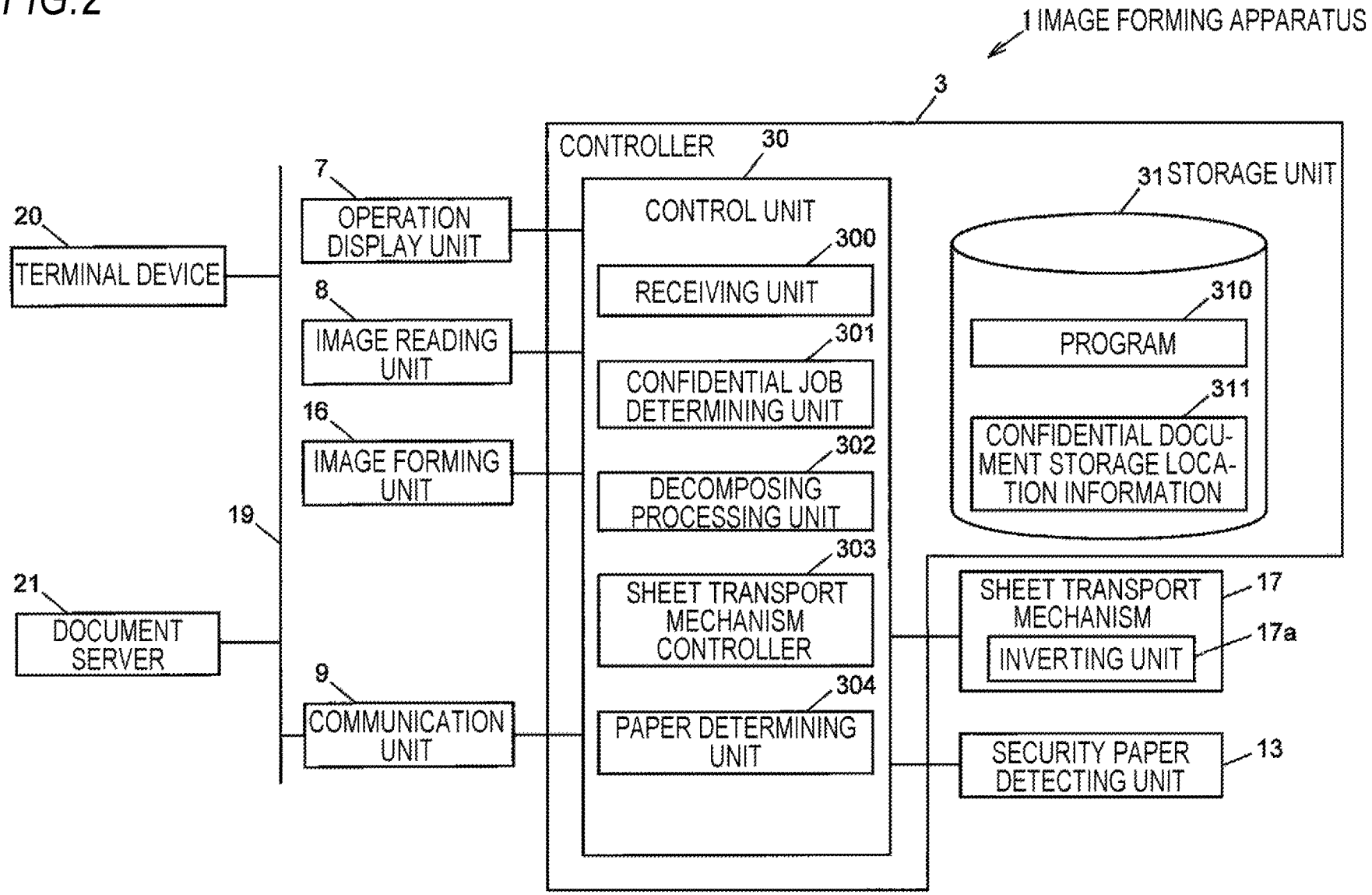
FIG. 2 is a block diagram illustrating an example of a control system of the image forming apparatus.

FIG. 2 is a block diagram illustrating an example of a control system of the image forming apparatus 1. A controller 3 of the image forming apparatus 1 is connected with the above-described security paper detecting unit 13 and sheet transport mechanism 17 and is further connected with an operation display unit 7, an image reading unit 8 and a communication unit 9. The communication unit 9 is connected via a network 19 with a terminal device 20 operated by a user and a document server 21 that manages documents. The operation display unit 7 is an example of an operation unit. The terminal device 20 is an example of an external device.

The image forming apparatus 1 executes a copy job or a print job as a printing job. The copy job is a job that uses data output from the image reading unit 8 to a control unit 30 (hereinafter, also referred to as "scan data") to cause the image forming unit 16 to execute a printing process. The print job is a job that uses data transmitted from the communication unit 9 to the control unit 30 to cause the image forming unit 16 to execute a printing process.

The operation display unit 7 includes a touch panel display on which a touch panel overlaps on a display unit such as a liquid crystal display, displays a display screen on the display unit, and receives an operation from a user to the touch panel. The operation display unit 7 may be configured with an input unit and a display unit provided independently of each other.

The image reading unit 8 reads a document image from a document to generate scan data (e.g., RGB print data), and includes an automatic document feeder provided on a document table, and a scanner. The image reading unit 8 optically reads a document image from a document placed on the document table or a document sent by the automatic document feeder. The image reading unit 8 transmits the generated scan data to the controller 3. The RGB print data is print data in which the color of each pixel is represented by RGB values.

When the user activates a printer driver to designate a file name of a document to be printed, the terminal device 20 acquires the corresponding document data and the storage location information of the document data from the document server 21 based on the file name designated by the printer driver. The printer driver converts the document data into PDL (Page Description Language) data to be printed, and transmits the print job together with the PDL data and the storage location information of the document data to the image forming apparatus 1 via the network 19. In addition, a user ID which identifies a user who operates the terminal device 20 may be set in the printer driver, and a confidential document may be stored in a folder dedicated to the confidential document in the document server 21 in association with the user ID.

For example, the document server 21 stores the confidential document in a folder dedicated to the confidential document and stores documents other than confidential document in other folders. The document server 21 exchanges files with the terminal device 20 and the image forming apparatus 1 by HTTPS (Hyper Text Transfer Protocol Security) communication. For example, the HTTPS communication uses a SSL (Secure Sockets Layer) protocol to perform encrypted communication in which communication contents are concealed. When there is an access from the terminal device 20, the document server 21 transmits the document data corresponding to the file name and the storage location information of the document data to the terminal device 20 by HTTP communication.

The controller 3 includes the control unit 30 that controls various units of the image forming apparatus 1, and a storage unit 31 that stores various kinds of information.

The control unit 30 includes a CPU (Central Processing Unit), an interface, and the like. The CPU operates in accordance with a program 310 to function as a receiving unit 300, a confidential job determining unit 301, a decomposing processing unit 302, a sheet transport mechanism controller 303, a paper determining unit 304, and the like. Details of the units 300 to 304 will be described later. The decomposing processing unit 302 is an example of a converting unit.

The storage unit 31 includes a ROM (Read Only Memory), a RAM (Random Access Memory), a hard disk, and the like, and stores various kinds of information such as the program 310 and confidential document storage location information 311. The confidential document storage location information 311 is storage location information indicating the storage location of the confidential document, for example, a folder path of the document server 21.

Next, the units 300 to 304 of the control unit 30 will be described.

The receiving unit 300 receives a copy job based on an operation on the operation display unit 7. In the copy job, scan data is received from the image reading unit 8. In addition, the receiving unit 300 receives PDL (Page Description Language) data and storage location information together with a print job from the printer driver of the terminal device 20. Hereinafter, the scan data and the PDL data are also referred to as print data.

The confidential job determining unit 301 determines whether the printing job received by the receiving unit 300 is a job requiring confidentiality (hereinafter, also referred to as a "confidential job"). When the printing job received by the receiving unit 300 is a copy job, the confidential job determining unit 301 determines that the copy job is a confidential job. When the printing job received by the receiving unit 300 is a print job, the confidential job determining unit 301 determines according to the storage location information of the document data designated by the printer driver. That is, when the storage location information is registered in the confidential document storage location information 311, the confidential job determining unit 301 determines that the printing job is a confidential job. When the storage location information is not registered, the confidential job determining unit 301 determines that the printing job is a normal printing job. For example, the confidential job determining unit 301 makes the above-described determination before the sheet P is fed from the sheet feed tray 4A.

The decomposing processing unit 302 performs a decomposing process. The decomposing process refers to a process of converting PDL data or scan data into image data in a bitmap format for each CMYK. That is, the decomposing process converts PDL data or scan data for color image into image data of CMYK and converts PDL data or scan data for black and white image into image data of K.

The sheet transport mechanism controller 303 controls the sheet transport mechanism 17 according to the printing mode instructed by the user. Further, the sheet transport mechanism controller 303 controls the sheet transport mechanism 17 so as to feed the sheet P from the sheet feed tray 4A before primary transfer.

When the sheet P is fed from the sheet feed tray 4A and a detection signal is transmitted from the security paper detecting unit 13 at a timing when the sheet P passes through the security paper detecting unit 13, the paper determining unit 304 determines that the fed sheet P is security paper. When the detection signal is not transmitted within a predetermined time including the timing at which the sheet P passes through the security paper detecting unit 13, the paper determining unit 304 determines that the fed sheet P is plain paper.

(Operation of First Exemplary Embodiment)

Figure 3:
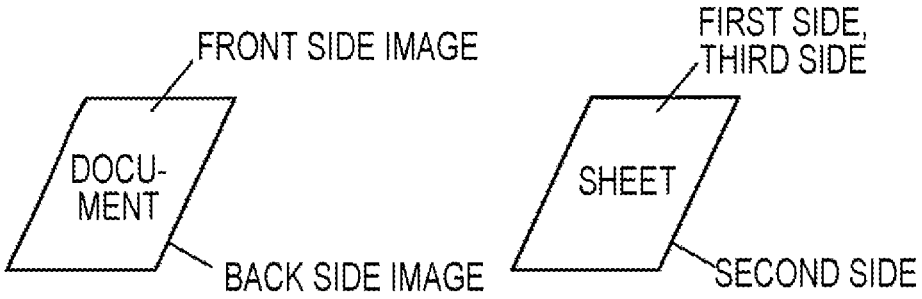
FIG. 3 is a table for explaining an example of the operation of the image forming apparatus according to the first exemplary embodiment.
Figure 4:
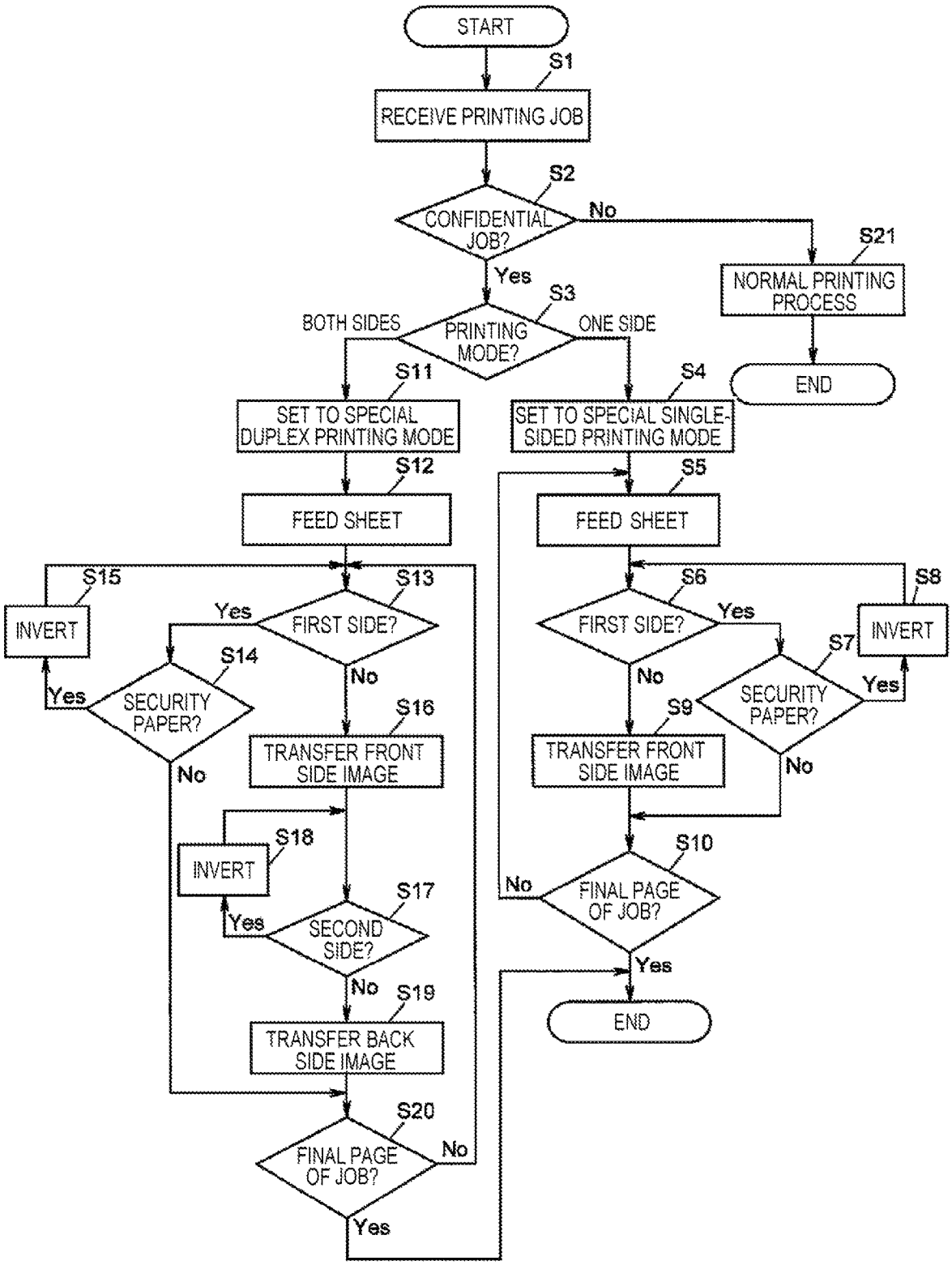
FIG. 4 is a flowchart illustrating an example of the operation of the image forming apparatus according to the first exemplary embodiment.

Next, an example of the operation of the image forming apparatus 1 when the "back side discharge" is designated will be described with reference to FIGS. 3 and 4. FIG. 3 is a table for explaining an example of the operation of the image forming apparatus 1. FIG. 4 is a flowchart illustrating an example of the operation of the image forming apparatus 1. In FIG. 3, a front side image is an image recorded on a first side of a document and a back side image is an image recorded on a second side of the document.

(1) In Case of Special Single-Sided Printing Mode

When the receiving unit 300 receives a printing job (S1), the confidential job determining unit 301 determines whether the printing job received by the receiving unit 300 is a confidential job (S2). When the printing job is a copy job to scan and copy a document, the confidential job determining unit 301 determines that the printing job is a confidential job. When PDL data and storage location information of document data are transmitted together with the print job from the terminal device 20 via the communication unit 9, the confidential job determining unit 301 determines that the printing job is a confidential job if the storage location information of the document data is registered in the confidential document storage location information 311 stored in the storage unit 31.

When it is determined that the printing job is a confidential job ("Yes" in S2), the confidential job determining unit 301 determines a printing mode (S3). When the printing mode is a single-sided printing mode, the confidential job determining unit 301 sets the printing mode to a special single-sided printing mode (S4).

The sheet transport mechanism controller 303 controls the sheet transport mechanism 17 to feed the sheet P from the sheet feed tray 4A (S5).

The sheet transport mechanism controller 303 determines whether a printing target side of the sheet P is the first side (S6). When the printing target side of the sheet P is the first side ("Yes" in S6), the paper determining unit 304 determines whether the fed sheet P is security paper (S7). When the sheet P is security paper ("Yes" in S7), the sheet transport mechanism controller 303 controls the inverting unit 17*a* to invert the sheet P by causing the sheet P to pass through the duplex printing path 64 (S8).

The decomposing processing unit 302 converts the scan data transmitted from the image reading unit 8 or the PDL data received from the terminal device 20 into CMYK image data and transfers the CMYK image data to the image forming unit 16 (S9).

When it is determined in the step S7 that the sheet P is plain paper ("No" in S7), the decomposing processing unit 302 performs no conversion of the scan data or the PDL data into CMYK image data.

The process of the steps S5 to S9 is repeated until the last page of the job (S10).

(2) In Case of Special Duplex Printing Mode

When the receiving unit 300 receives a printing job (S1), the confidential job determining unit 301 determines whether the printing job received by the receiving unit 300 is a confidential job (S2).

When it is determined that the printing job is a confidential job ("Yes" in S2), the confidential job determining unit 301 determines a printing mode (S3). When the printing mode is a duplex printing mode, the confidential job determining unit 301 sets the printing mode to a special duplex printing mode (S11).

The sheet transport mechanism controller 303 controls the sheet transport mechanism 17 to feed the sheet P from the sheet feed tray 4A (S12).

The sheet transport mechanism controller 303 determines whether a printing target side of the sheet P is the first side (S13). When the printing target side of the sheet P is the first side ("Yes" in S13), the paper determining unit 304 determines whether the fed sheet P is security paper (S14). When the sheet P is security paper ("Yes" in S14), the sheet transport mechanism controller 303 controls the inverting unit 17*a* to invert the sheet P by causing the sheet P to pass through the duplex printing path 64 (S15).

The decomposing processing unit 302 converts the scan data transmitted from the image reading unit 8 or the PDL data for the first side received from the terminal device 20 into CMYK image data and transfers the CMYK image data to the image forming unit 16 (S16).

The sheet transport mechanism controller 303 determines whether a printing target side of the sheet P is the second side (S17). When the printing target side of the sheet P is the second side ("Yes" in S17), the sheet transport mechanism controller 303 controls the inverting unit 17*a* to invert the sheet P by causing the sheet P to pass through the duplex printing path 64 (S18).

The decomposing processing unit 302 converts the scan data transmitted from the image reading unit 8 or the PDL data for the second side received from the terminal device 20 into CMYK image data and transfers the CMYK image data to the image forming unit 16 (S19).

When it is determined in the step S14 that the sheet P is plain paper ("No" in S14), the decomposing processing unit 302 performs no conversion of the scan data or the PDL data into CMYK image data.

The process of the steps S13 to S19 is repeated until the last page of the job (S20).

Second Exemplary Embodiment

A second exemplary embodiment of the present invention involves installing the image forming apparatus 1 according to the first exemplary embodiment in a specific area (including a room) provided with a gate that detects security paper at an entrance.

The gate includes a security paper detecting unit having the same function as the security paper detecting unit 13 and a communication unit that communicates a result of detection of security paper by the security paper detecting unit to an external device.

The security paper detecting unit may detect that a confidential document is printed on a sheet of the security paper and is taken out from a specific area to the outside through the gate. At this time, a warning may be notified from the gate to an administrator of the terminal device. The installation location of the image forming apparatus 1 is not limited to this area.

Third Exemplary Embodiment

A schematic configuration example of an image forming apparatus according to a third exemplary embodiment has substantially the same as the schematic configuration example of the image forming apparatus according to the exemplary embodiment illustrated in FIG. 1. Hereinafter, differences from the first and second exemplary embodiments will be mainly described.

The image forming apparatus 1 includes a retract mechanism 18 that moves the photoconductor drum units 164C, 164M and 164Y of CMY other than K from positions at which the photoconductor drums 161C, 161M and 161Y are in contact with the intermediate transfer belt 173 to positions at which the photoconductor drums 161C, 161M and 161Y are in no contact with the intermediate transfer belt 173 (retract positions). The retract mechanism 18 will be described later with reference to FIG. 5. The retract mechanism 18 is an example of a moving unit. CMY is an example of predetermined color components.

(Printing Mode)

The image forming apparatus 1 has, for example, a "single-sided printing mode" to form an image on one side of a sheet P, and a "duplex printing mode" to form an image on both sides of the sheet P.

Further, in the "single-sided printing mode" and the "duplex printing mode", the image forming apparatus 1 may designate "back side discharge" for discharging a sheet P with a first printed side being the back side of the sheet or "front side discharge" for discharging a sheet with a first printed side being the front side of the sheet P.

(Configuration of Retract Mechanism)

Figure 5:
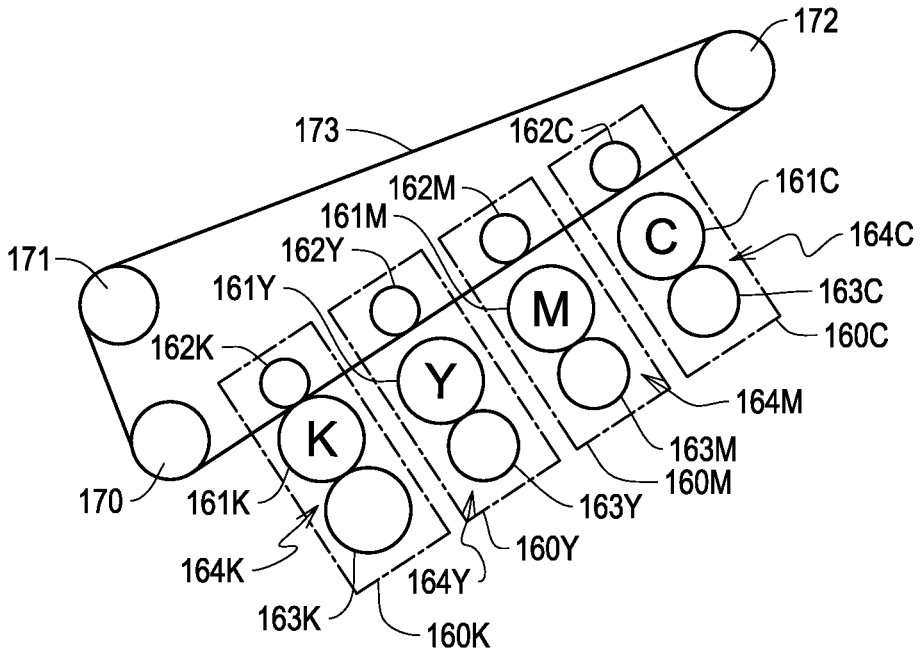
FIG. 5 is a schematic view of a main portion for explaining a retract mechanism.

FIG. 5 illustrates a state in which the CMY photoconductor drum units 164C, 164M and 164Y are moved to the retract positions. Under control of a retract mechanism controller 305, the retract mechanism 18 moves the CMY photoconductor drum units 164C, 164M and 164Y between positions at which the photoconductor drums 161C, 161M and 161Y are in contact with the intermediate transfer belt 173 and positions (retract positions) at which the photoconductor drums 161C, 161M and 161Y are in no contact with the intermediate transfer belt 173. In the present exemplary embodiment, the positions at which the CMY photoconductor drums 161C, 161M and 161Y are in contact with the intermediate transfer belt 173 are normal.

The retract mechanism 18 includes, for example, a spring member that presses the CMY photoconductor drum units 164C, 164M and 164Y against the intermediate transfer belt 173, a cam, a motor that rotates the cam, and a drive circuit that drives the motor. In a normal state, the retract mechanism 18 presses the CMY photoconductor drum units 164C, 164M and 164Y against the intermediate transfer belt 173 by a spring force of the spring member. When CMY toner images are not transferred onto the intermediate transfer belt 173, the retract mechanism 18 drives the motor by the drive circuit to rotate the cam, and moves the CMY photoconductor drum units 164C, 164M and 164Y to the retract positions against the spring force of the spring member.

Figure 6:
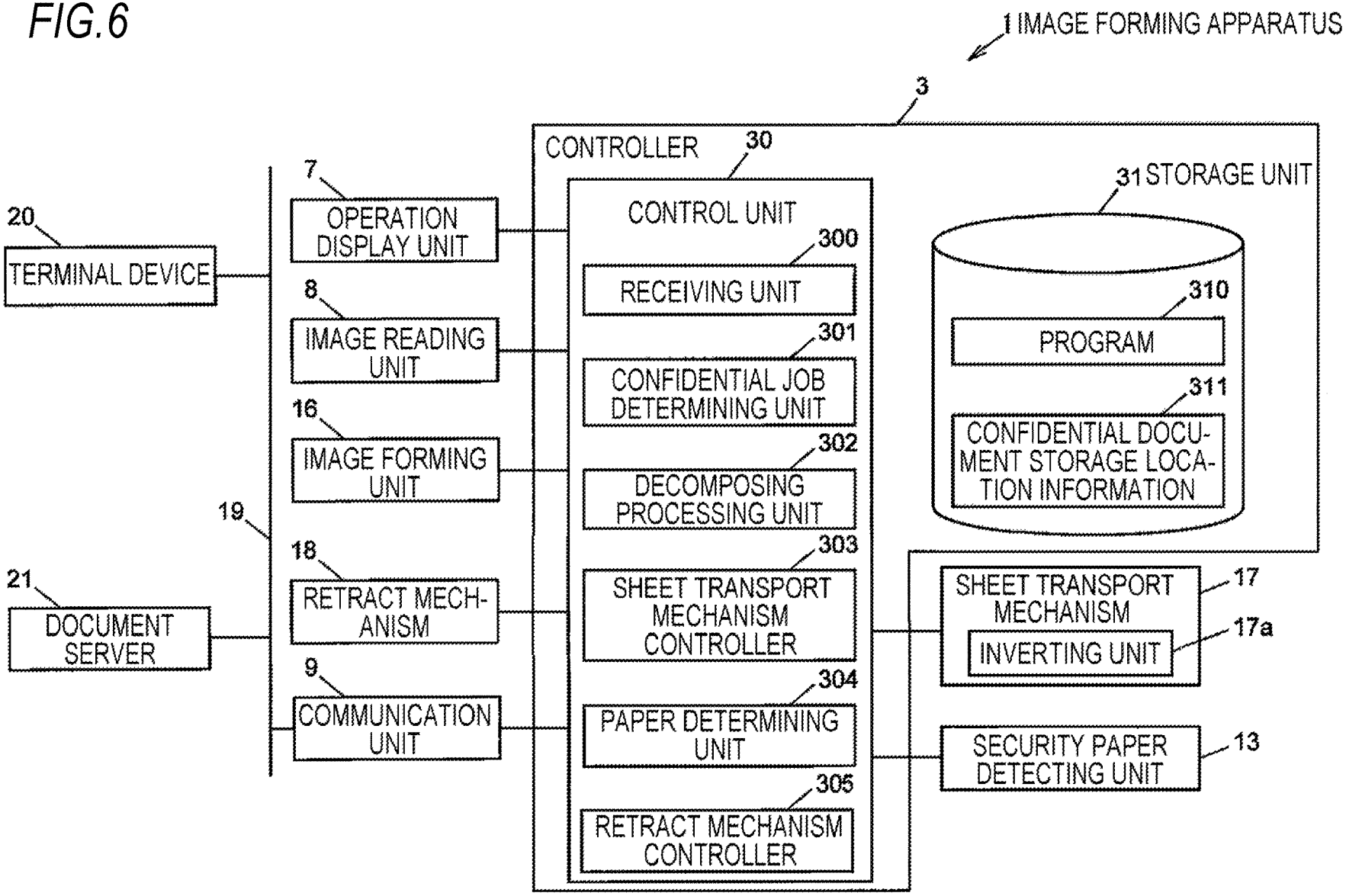
FIG. 6 is a block diagram illustrating an example of a control system of an image forming apparatus according to a third exemplary embodiment.

FIG. 6 is a block diagram illustrating an example of a control system of the image forming apparatus 1 according to the third exemplary embodiment.

The control unit 30 includes a CPU (Central Processing Unit), an interface, and the like. The CPU operates in accordance with a program 310 to function as a receiving unit 300, a confidential job determining unit 301, a decomposing processing unit 302, a sheet transport mechanism controller 303, a paper determining unit 304, a retract mechanism controller 305, and the like. Details of the units 300 to 305 will be described later. The retract mechanism controller 305 is an example of a moving unit.

When it is determined by the confidential job determining unit 301 that the printing job is a confidential job, the decomposing processing unit 302 performs a decomposing process which does not use K. In the present exemplary embodiment, since the decomposing process does not use K, PDL data or scan data for color image or black and white image is converted into CMY image data, but no image data of K is generated.

In addition, when it is determined by the confidential job determining unit 301 that the printing job is not a confidential job, the decomposing processing unit 302 performs the normal decomposing process.

When the confidential job determining unit 301 determines that the printing job is a confidential job and the paper determining unit 304 determines that the sheet P is plain paper, the retract mechanism controller 305 controls the retract mechanism 18 so that the CMY photoconductor drums 161C, 161M and 161Y are located at the positions at which the CMY photoconductor drums 161C, 161M and 161Y are in no contact with the intermediate transfer belt 173 by relative movement to the intermediate transfer belt 173. The retract mechanism 18 of the present exemplary embodiment is normally in a state where the CMY photoconductor drums 161C, 161M and 161Y are in contact with the intermediate transfer belt 173. Therefore, when the printing job is a confidential job and the sheet P is plain paper, the retract mechanism controller 305 controls the retract mechanism 18 to move the CMY photoconductor drum units 164C, 164M and 164Y to the positions at which the CMY photoconductor drums 161C, 161M and 161Y are in no contact with the intermediate transfer belt 173.

(Operation of Third Exemplary Embodiment)

Figure 8:
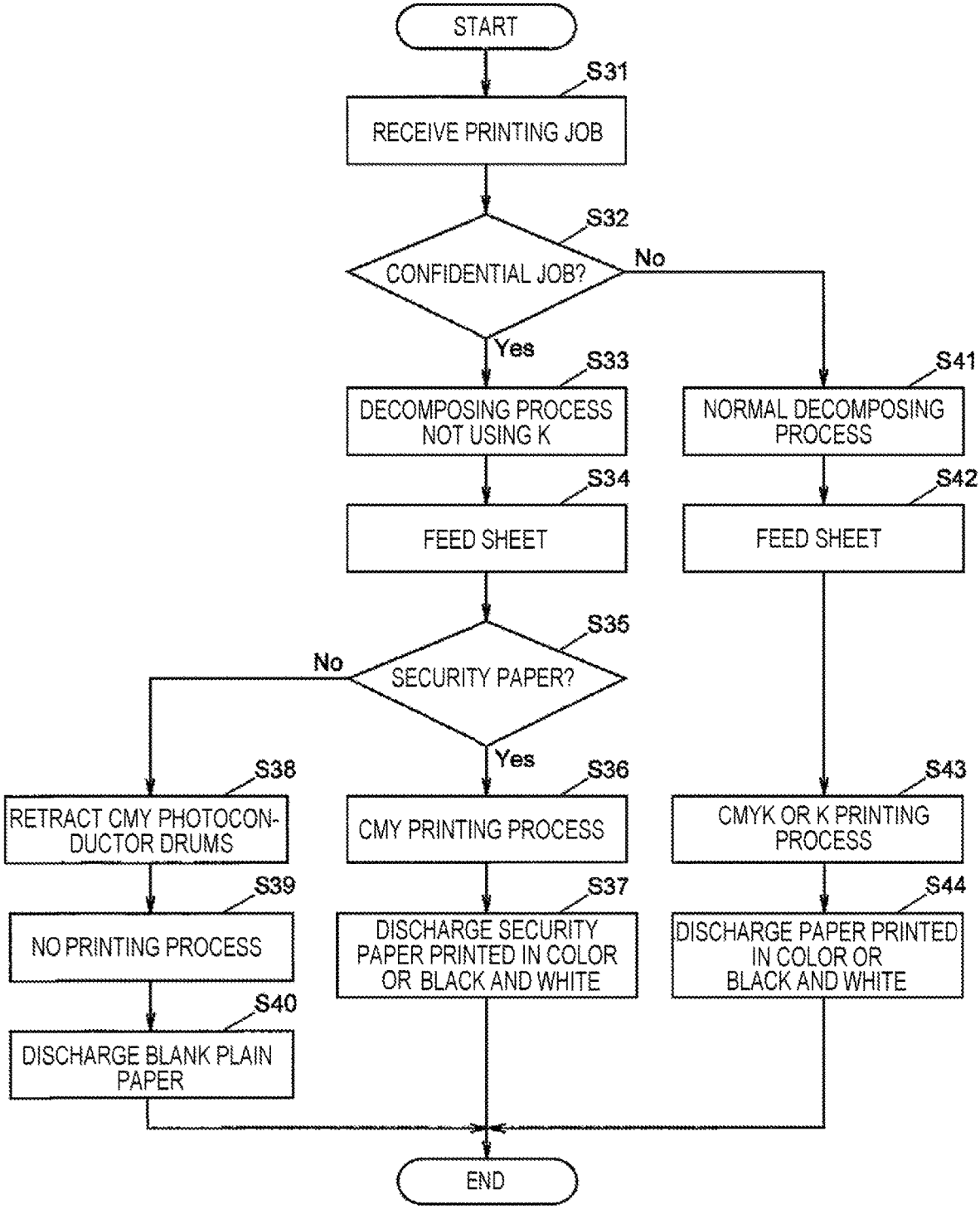
FIG. 8 is a flowchart illustrating an example of the operation of the image forming apparatus according to the third exemplary embodiment.

Next, an example of the operation of the image forming apparatus 1 according to the third exemplary embodiment will be described with reference to FIGS. 7 and 8. FIG. 7 is a table for explaining an example of the operation of the image forming apparatus 1. FIG. 8 is a flowchart illustrating an example of the operation of the image forming apparatus 1.

When the receiving unit 300 receives a printing job (S31), the confidential job determining unit 301 determines whether the printing job received by the receiving unit 300 is a confidential job (S32). When the printing job is a copy job to scan and copy a document, the confidential job determining unit 301 determines that the printing job is a confidential job. When PDL data and storage location information of document data are transmitted together with the print job from the terminal device 20 via the communication unit 9, the confidential job determining unit 301 determines that the printing job is a confidential job if the storage location information of the document data is registered in the confidential document storage location information 311 stored in the storage unit 31.

When it is determined that the printing job is a confidential job ("Yes" in S32), the decomposing processing unit 302 performs a decomposing process not using K (S33).

The sheet transport mechanism controller 303 controls the sheet transport mechanism 17 to feed a sheet. The sheet P is taken out from the sheet feed tray 4A and is fed to the sheet transport path 6 (S34).

The paper determining unit 304 determines whether the sheet P is security paper based on the presence or absence of a detection signal from the security paper detecting unit 13 (S35).

When it is determined that the sheet P is security paper ("Yes" in S35), the control unit 30 controls the image forming unit 16 so as to perform a CMY printing process (S36).

The sheet of the security paper printed with a CMY color image or a black and white image is discharged to the sheet discharge tray 5 (S37).

When it is determined in the step S35 that the sheet P is plain paper ("No" in S35), the retract mechanism controller 305 controls the retract mechanism 18 to move the CMY photoconductor drum units 164C, 164M and 164Y to a position at which the CMY photoconductor drum units 164C, 164M and 164Y are in no contact with the intermediate transfer belt 173 (S38).

The K photoconductor drum 161K is in contact with the intermediate transfer belt 173. However, no toner image is formed on the K photoconductor drum 161K. Thus, even when a toner image is secondarily transferred from the intermediate transfer belt 173 to the sheet P, the sheet of plain paper is discharged as a blank sheet to the sheet discharge tray 5 (S40).

When it is determined in the step S32 that the printing job is not a confidential job ("No" in S32), the decomposing processing unit 302 performs the normal decomposing process (S41).

The sheet transport mechanism controller 303 controls the sheet transport mechanism 17 to feed a sheet. The sheet P is taken out from the sheet feed tray 4A and is fed to the sheet transport path 6 (S42).

The control unit 30 controls the image forming unit 16 to perform a CMYK printing process (S43).

A sheet of plain paper printed with a CMYK color image or a black and white image is discharged to the sheet discharge tray 5 (S44).

Fourth Exemplary Embodiment

Figure 9:
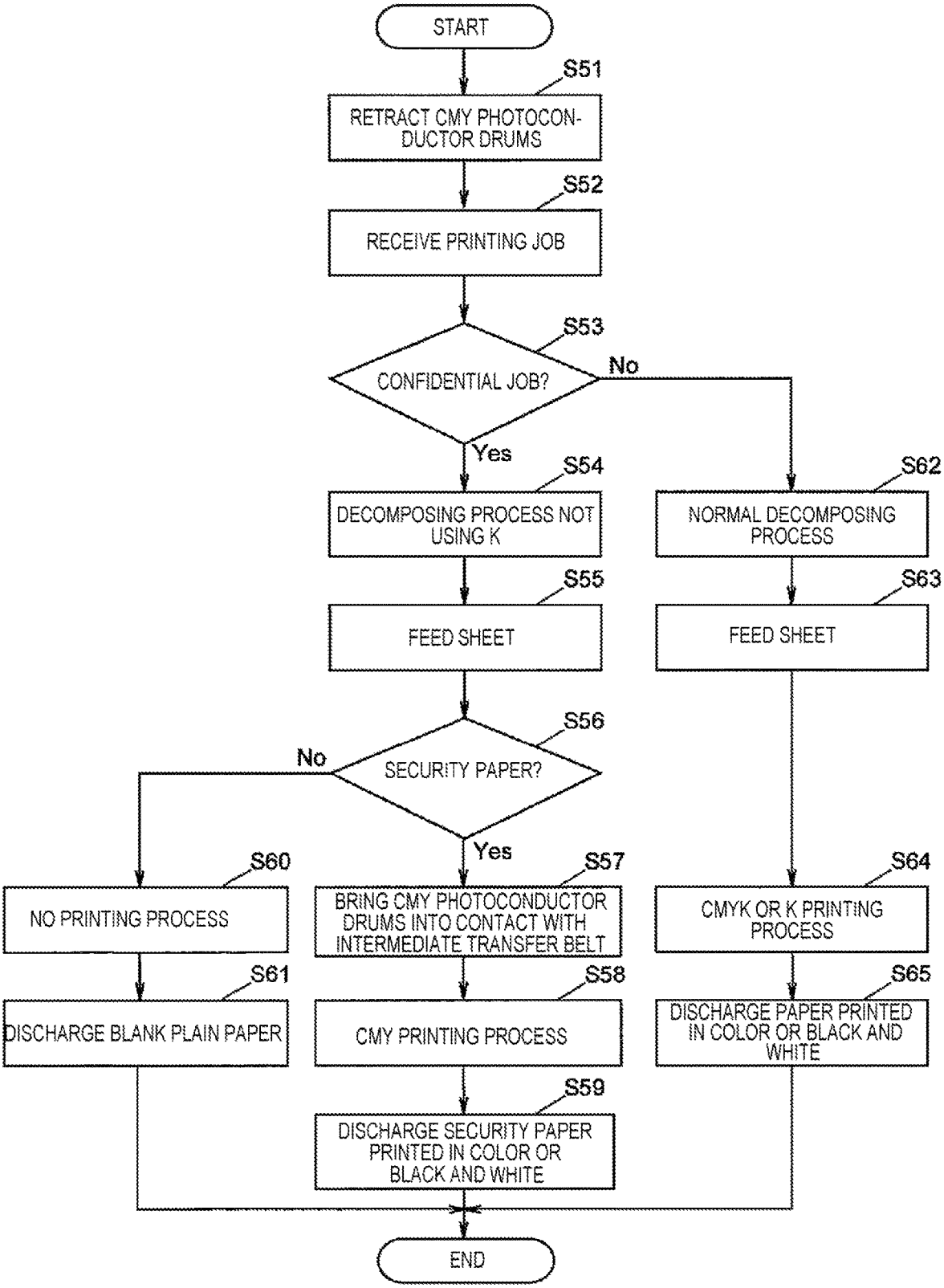
FIG. 9 is a flowchart illustrating an example of the operation of an image forming apparatus according to a fourth exemplary embodiment of the present invention.

FIG. 9 is a flowchart illustrating an example of the operation of an image forming apparatus according to a fourth exemplary embodiment of the present invention; and in the third exemplary embodiment, the positions at which the CMY photoconductor drums 161C, 161M and 161Y are in contact with the intermediate transfer belt 173 are normal. On the other hand, in the present exemplary embodiment, positions (retract positions) at which the CMY photoconductor drums 161C, 161M and 161Y are in not contact with the intermediate transfer belt 173 are normal, and the other structures and configurations are the same as those of the third exemplary embodiment. Hereinafter, differences from the third exemplary embodiment will be mainly described.

When a CMY toner image is transferred onto the intermediate transfer belt 173, the retract mechanism 18 of the present exemplary embodiment brings the CMY photoconductor drums 161C, 161M and 161Y into contact with the intermediate transfer belt 173 under control of the retract mechanism controller 305.

First, as an initial state, the retract mechanism controller 305 controls the retract mechanism 18 to move the CMY photoconductor drums 161C, 161M and 161Y away from the intermediate transfer belt 173 (S51).

When the receiving unit 300 receives a printing job (S52) in the same way as in the third exemplary embodiment, the confidential job determining unit 301 determines whether the printing job received by the receiving unit 300 is a confidential job (S53) in the same way as in the third exemplary embodiment.

When it is determined that the printing job is a confidential job ("Yes" in S53), the decomposing processing unit 302 performs a decomposing process that does not use K (S54).

The sheet transport mechanism controller 303 controls the sheet transport mechanism 17 to feed a sheet. The sheet P is taken out from the sheet feed tray 4A and is fed to the sheet transport path 6 (S55).

The paper determining unit 304 determines whether the sheet P is security paper based on the presence or absence of a detection signal from the security paper detecting unit 13 (S56).

When the security paper is detected ("Yes" in S56), the retract mechanism controller 305 controls the retract mechanism 18 to bring the CMY photoconductor drums 161C, 161M and 161Y into contact with the intermediate transfer belt 173 (S57).

The control unit 30 controls the image forming unit 16 to perform a CMY printing process (S58).

The sheet of the security paper printed with a CMY color image or a black and white image is discharged to the sheet discharge tray 5 (S59).

When it is determined in the step S56 that the sheet P is plain paper ("No" in S56), the retract mechanism controller 305 holds the CMY photoconductor drums 161C, 161M and 161Y to be at the positions at which the CMY photoconductor drums 161C, 161M and 161Y are in no contact with the intermediate transfer belt 173.

The K photoconductor drum 161K is in contact with the intermediate transfer belt 173. However, no toner image is formed on the K photoconductor drum 161K. Thus, even when a toner image is secondarily transferred from the intermediate transfer belt 173 onto the sheet P, the sheet of plain paper is discharged as a blank sheet to the sheet discharge tray 5 (S61).

When it is determined in the step S53 that the printing job is not a confidential job ("No" in S53), the decomposing processing unit 302 performs the normal decomposing process (S62).

The sheet transport mechanism controller 303 controls the sheet transport mechanism 17 to feed a sheet. The sheet P is taken out from the sheet feed tray 4A and is fed to the sheet transport path 6 (S63).

The control unit 30 controls the image forming unit 16 to perform a CMYK printing process (S64).

The sheet of plain paper printed with a CMYK color image or a black and white image is discharged to the sheet discharge tray 5 (S65).

Fifth Exemplary Embodiment

A fifth exemplary embodiment of the present invention involves installing the image forming apparatus 1 according to the third or fourth exemplary embodiment in a specific area (including a room) provided with a gate for detecting security paper at an entrance.

The gate includes a security paper detecting unit having the same function as the security paper detecting unit 13 and a communication unit that communicates a result of detection of security paper by the security paper detecting unit to an external device.

The security paper detecting unit may detect that a confidential document is printed on a sheet of the security paper and is taken out from a specific area to the outside through the gate. At this time, a warning may be notified from the gate to an administrator of the terminal device. The installation location of the image forming apparatus 1 is not limited to this area.

(Modification 1)

In the above exemplary embodiments, a sheet of the security paper is fed from the sheet feed tray 4A and the security paper detecting unit 13 is provided on the sheet pickup side of the sheet feed tray 4A. Alternatively, the security paper detecting unit 13 may be provided on the sheet pickup side of the manual feed tray 4B and a sheet of the security paper may be fed from the manual feed tray 4B.

(Modification 2)

When it is determined that the sheet P is not security paper in the steps S6 and S13 of the flowchart illustrated in FIG. 4, the step S35 of the flowchart illustrated in FIG. 8, and the step S56 of the flowchart illustrated in FIG. 9, or when a blank sheet of plain paper is discharged, a warning indicating that the sheet P is not security paper may be displayed on the operation display unit 7. The warning may be generated with only a sound or may be generated with a sound together with visual display.

(Modification 3)

In the first and second exemplary embodiments, the front side image is printed on the second side in the special single-sided printing mode. However, the front side image may be printed on a fourth or later side (corresponding to the first side). In addition, in the first and second exemplary embodiments, the front side image is printed on the second side in the special duplex printing mode and the back side image is printed on the third side (corresponding to the first side). Alternatively, the front side image may be printed after the third side and the back side image may be printed after the fourth side (corresponding to the second side).

(Modification 4)

In the first and second exemplary embodiments, the front side image is printed on the second side of the sheet of the security paper and the back side image is printed on the third side in the special duplex printing mode. Alternatively, the back side image may be printed on the second side and the front side image may be printed on the third side.

(Modification 5)

Figure 10A:
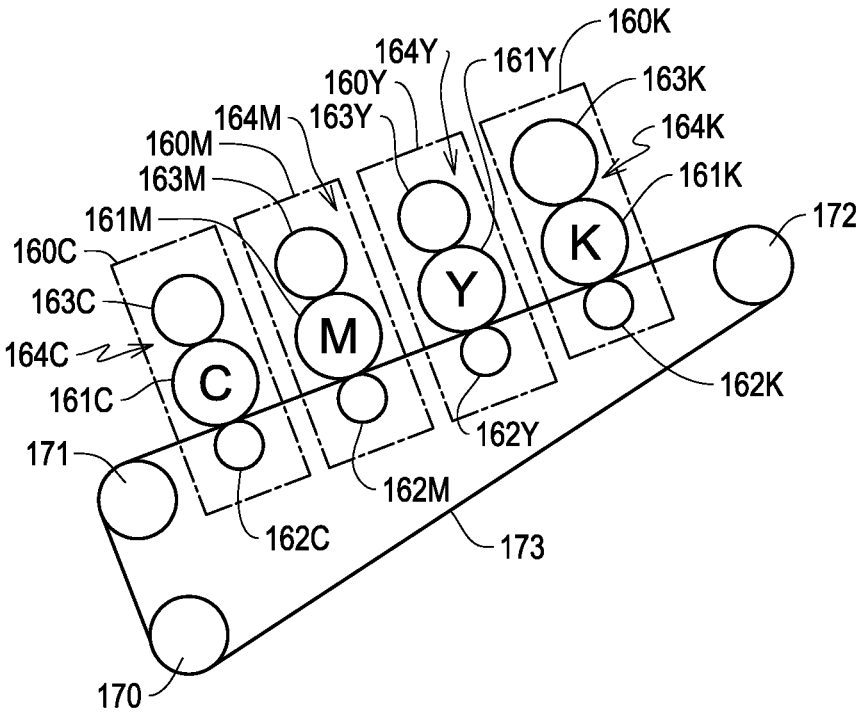
FIGS. 10A and 10B are schematic views of a main portion for explaining a modification of the retract mechanism, before retraction and after retraction, respectively.
Figure 10B:
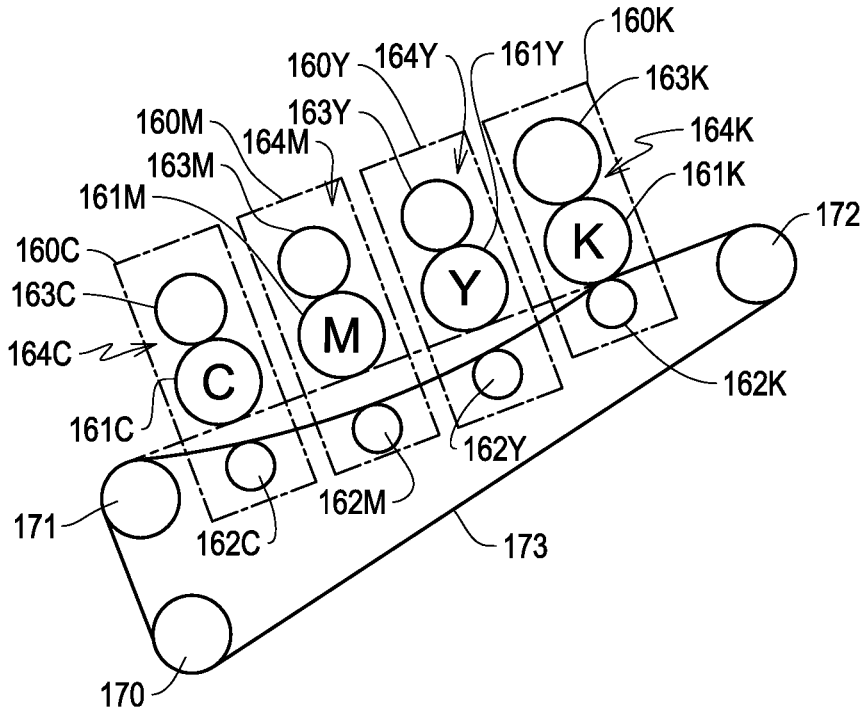

FIGS. 10A and 10B are schematic views of a main portion for explaining another configuration of the retract mechanism as Modification 5, before retraction and after retraction, respectively.

In the third to fifth exemplary embodiments, the retract mechanism 18 moves the CMY photoconductor drum units 164C, 164M and 164Y to bring the CMY photoconductor drums 161C, 161M and 161Y into contact with the intermediate transfer belt 173. On the other hand, in Modification 5, the primary transfer roller 162 is moved to bring the intermediate transfer belt 173 into contact with the CMY photoconductor drums 161C, 161M and 161Y. Even in this case, the K photoconductor drum 161K is kept in contact with the intermediate transfer belt 173 at all times.

(Modification 6)

In the third to fifth exemplary embodiments, the security paper is predetermined paper. Alternatively, the predetermined paper may be a sheet of plain paper one side of which is printed and the other side of which is blank or sheets of plain paper both sides of which are not printed. In this case, when a printed side of a sheet (the other side of which is blank) is fed as a printing target side or when a sheet both side of which is printed is fed, the fed sheet is paper other than the predetermined paper.

(Modification 7)

In the step S33 of the flowchart illustrated in FIG. 8 and the step S64 of the flowchart illustrated in FIG. 9, the CMY photoconductor drums 161C, 161M and 161Y are not moved to the positions (retract positions) at which the CMY photoconductor drums 161C, 161M and 161Y are in no contact with the intermediate transfer belt 173. However, when the print data is data for a black and white image, the CMY photoconductor drums 161C, 161M and 161Y may be moved to the retract positions.

The exemplary embodiments of the present invention have been described above. It should be noted that the present invention is not limited to the above-described exemplary embodiments, but various modifications and implementations may be made without departing from the spirit and scope of the present invention.

Each of the various units of the control unit 30 may be partially or entirely implemented by a hardware circuit such as a reconfigurable circuit (e.g., FPGA (Field Programmable Gate Array)), an application specific integrated circuit (ASIC), or the like.

Some constituent elements of the above exemplary embodiments may be omitted or altered without departing the spirit and scope of the present invention. In addition, in the flows of the above exemplary embodiments, some steps may be added, deleted, changed, exchanged, etc., without departing from the spirit and scope of the present invention. Further, the programs used in the above exemplary embodiments may be recorded and provided in the form of a computer-readable recording medium such as a CD-ROM. Furthermore, the programs used in the above exemplary embodiments may be stored in an external server such as a cloud server and may be downloaded via a network.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an inverting unit that inverts a sheet by causing the sheet to pass through an inverting path when an image forming process for forming images on both sides of the sheet is performed;

an image forming unit that forms an image on a second or later side of the sheet based on image data for the first side and forms an image on a third or later side of the sheet based on image data for the second side;

a controller that starts the image forming process upon receiving print data as a target to be printed on specific paper, and inverts a sheet fed from a sheet feeding unit once or more by the inverting unit; and a converting unit that, when the sheet fed from the sheet feeding unit is the specific paper, converts the print data for the first side which is received as the target to be printed on the specific paper into image data for an N-th side where N≥2 and transfers the image data for the N-th side to the image forming unit.

2. The image forming apparatus according to claim 1, wherein when the sheet fed from the sheet feeding unit is paper other than the specific paper, the image forming unit does not form an image on the N-th side of the sheet.

3. The image forming apparatus according to claim 2, wherein when the sheet fed from the sheet feeding unit is the paper other than the specific paper, the converting unit does not transfer the converted image data to the image forming unit.

4. The image forming apparatus according to claim 2, wherein when the sheet fed from the sheet feeding unit is the paper other than the specific paper, the converting unit transfers the converted image data to the image forming unit and then instructs to stop forming of the image based on the image data.

5. The image forming apparatus according to claim 1, wherein the controller changes an instruction of a single-sided image forming process for forming an image on the first side of the sheet to an instruction of a specific single-sided image forming process for forming an image on the second side of the sheet, and changes an instruction of a duplex image forming process for forming images on both sides of the sheet to an instruction of a specific duplex image forming process for inverting the sheet twice.

6. The image forming apparatus according to claim 1, further comprising:

a determining unit that determines whether the print data is the target to be printed on the specific paper.

7. The image forming apparatus according to claim 6, further comprising:

an operation unit that receives an operation of a user, wherein upon receiving a printing instruction for the print data by the operation unit being operated, the determining unit determines that the print data is the target to be printed on the specific paper.

8. The image forming apparatus according to claim 6, wherein upon receiving a printing instruction for the print data from an external device, the determining unit determines whether the print data is the target to be printed on the specific paper based on information included in the printing instruction.

9. The image forming apparatus according to claim 8, wherein the printing instruction includes storage location information indicating a storage location of the print data, and when the storage location information is included in storage location information stored in advance, the determining unit determines that the print data is the target to be printed on the specific paper.

10. The image forming apparatus according to claim 6, wherein the determining unit determines whether the print data is the target to be printed on the specific paper before the sheet is fed from the sheet feeding unit.

11. The image forming apparatus according to claim 1, further comprising:

a primary transfer unit that primarily transfers a toner image formed on an image carrier based on the image data, onto an intermediate transfer body; and a secondary transfer unit that secondarily transfers the toner image on the intermediate transfer body onto the sheet, wherein the sheet feeding unit feeds the sheet before the primary transfer.

12. The image forming apparatus according to claim 1, wherein the print data is a confidential document, and the specific paper is paper provided with a magnetic body.

13. The image forming apparatus according to claim 1, wherein the print data received as the target to be printed on the specific paper includes the print data for the first side and the print data for the second side, and when the sheet fed from the sheet feeding unit is the specific paper, the converting unit converts the print data for the first side into the image data for the N-th side where N≥2, converts the print data for the second side into image data for an (N+1)-th side, and transfers the image data for the N-th side and the image data for the (N+1)-th side to the image forming unit.

14. The image forming apparatus according to claim 13, wherein when the sheet fed from the sheet feeding unit is paper other than the specific paper, the image forming unit does not perform the image forming process on both sides of the sheet.

15. The image forming apparatus according to claim 1, wherein the print data received as the target to be printed on the specific paper includes print data for the first side and print data for the second side, and when the sheet fed from the sheet feeding unit is the specific paper, the converting unit converts the print data for the second side into the image data for the N-th side where N≥2, converts the print data for the first side into image data for an (N+1)-th side, and transfers the image data for the N-th side and the image data for the (N+1)-th side to the image forming unit.

* * * * *